United States Patent [19]

Vigue et al.

[11] Patent Number: 5,036,980

[45] Date of Patent: Aug. 6, 1991

[54] NESTABLE FOOD CONTAINER HAVING IMPROVED CLOSURE SYSTEM

[75] Inventors: Henry R. Vigue, Waterville, Me.; Mangat Rai Sarma, Jevnaker, Norway

[73] Assignee: Keyes Fibre, Waterville, Me.

[21] Appl. No.: 525,144

[22] Filed: May 17, 1990

[51] Int. Cl.[5] ..... B65D 21/02

[52] U.S. Cl. ..... 206/515; 220/4.42; 229/2.5 R; 229/DIG. 13

[58] Field of Search ..... 206/503, 518, 515; 220/4 B, 4 E, 306, 326, 4.21, 4.24; 229/2.5 R, 125.36, DIG. 13

[56] References Cited

U.S. PATENT DOCUMENTS

D. 263,684 4/1982 Davis .
3,620,403 11/1971 Rump .
3,800,998 4/1974 Gask ..... 229/2.5 R
3,876,130 4/1975 Haase ..... 229/2.5 R
3,933,295 1/1976 Congleton .
3,938,726 2/1976 Holden, Jr. et al. ..... 229/2.5 R
4,096,986 6/1978 Florian ..... 229/2.5 R
4,098,453 7/1978 Arneson ..... 229/2.5 R
4,294,371 10/1981 Davis ..... 229/2.5 R

FOREIGN PATENT DOCUMENTS 1602694 11/1981 United Kingdom .

*Primary Examiner*—Jimmy G. Foster
*Attorney, Agent, or Firm*—Connolly & Hutz

[57] ABSTRACT

A nestable food container is disclosed which is reversible to define a dish or a cover in a composite container. A male and female locking arrangement is provided on the container, together with a stabilizing system of protrusions and depressions to stabilize the locked container engagement.

4 Claims, 2 Drawing Sheets

NESTABLE FOOD CONTAINER HAVING IMPROVED CLOSURE SYSTEM

FIELD OF THE INVENTION

The invention relates to containers, particularly containers for food. The container is combinable and interlockable with a second, preferably identical, container to form a substantially closed composite container.

BACKGROUND AND PRIOR ART

In the food service industry, there is a need for convenient food service containers. Such containers may take the form of plastic, fibrous, or paper dishes for serving stews, soups, salads or the like. Preferably the dish container design is such that the containers are stackable or nestable for convenient storage using a minimum of space.

Dish-like food containers may be provided with interlocking covers for use, for example, when food is to be carried off the premises. These covers in the past have been made to engage the dish for closure using various fastening means, for example, tongue-in-groove locking arrangements wherein female and male locking members are provided on the dish and/or on the cover. Certain container constructions have comprised integral bottom and cover portions which are joined at a flexible joint, which construction is popular for serving take-out sandwiches.

Dish-like containers may be fashioned such that the dish and cover are identical and their use reversible, i.e. a single dish construction may serve either as a dish, when used alone, or as a closed container, when two such dishes are used in combination by inverting one container for use as a cover for a second container. This type of structure is desirable in that it obviates the need to stock and store separate dishes and covers. Structures of this type are shown, for example, in U.S. Pat. No. 3,933,295; U.S. Pat. No. 3,620,403; U.S. Pat. No. Des. 263,684; and U.K. Patent Specification No. 1,602,694.

Reversible dish/cover containers of the type aforesaid may be provided with a circumferential or peripheral flange surrounding the open surface of the dish. When two such containers are combined to form a closed container, the surface of the respective flanges are abutted in a sealing relationship, and the tongue-in-groove arrangement interlocks the containers. One end of the flange on the reversible container may be provided with a male locking member, such as an integral tongue, and the opposed end is provided with a female locking member, such as a groove. From a nested stack of such identical containers, the dish and cover are removed as necessary, and the container to serve as cover is inverted relative to the dish container in order to align the male and female locking members for engagement.

Conventional tongue-in-groove closure arrangements for locking food containers can be ineffective in maintaining the locked relationship of the dish and its cover. Frequently, such containers are made of flexible, bendable material such as foam plastic or paper, and a force exerted on the side or top of the container may be sufficient to disengage the closure, making it difficult to transport food within the closed container.

SUMMARY OF THE INVENTION

With the foregoing in mind, it is an object of the invention to provide a nestable food container of the type in which one unit may be combined with a like unit to form a lockingly closed food container.

It is a further object of the invention to provide an improved locking means for maintaining and stabilizing the locked relationship between two containers forming a closed composite container.

The invention comprises a container, particularly a container for food, in the form of a dish-shaped shell having an outer peripheral flange surrounding the open end of the container. Male and female locking members are disposed within the peripheral flange. Two like containers may be interlocked to form a substantially closed composite container. The male and female locking members are disposed at substantially opposing positions on the flange, such that when one container is inverted and rotated 180° relative to a second container, the male and female members of the first container are positioned to lockingly engage the female and male members, respectively, of the second container. A lock stabilizer means is provided to reduce inadvertent unlocking when forces are applied to the composite container. The lock stabilizer means preferably comprises a system of integral protrusions and depressions within the peripheral flange.

BRIEF DESCRIPTION OF THE DRAWINGS

The drawings illustrate a currently preferred embodiment of the invention, wherein.

DETAILED DESCRIPTION OF THE INVENTION

The container in accordance with the invention may be constructed from a lightweight material such as foam plastic or cardboard. Means for forming or molding articles from these materials in a desired configuration are well known in the art. The preferred material presently contemplated for forming a container of the type herein disclosed is cellulose fiber. As is known in the art, fibers may be vacuum-extracted from an aqueous fiber slurry into a perforated mold to form an article having virtually any desired shape or configuration. Using this method, structural details or features such as flanges, recesses, protrusions, depressions and the like may be formed integrally in the final container structure during molding.

Figure 2:
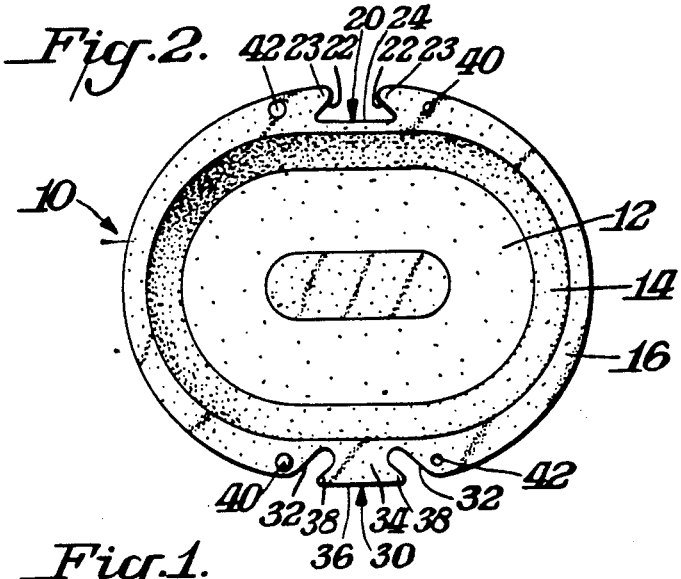
FIG. 2 is a top plan view thereof.
Figure 4:
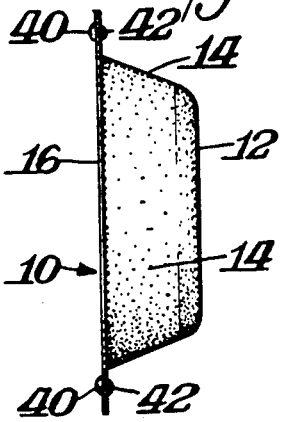
FIG. 4 is an end view thereof.

Referring to FIGS. 1–4, a container 10 comprises a base 12 and sidewall 14. The container 10 is shown in FIG. 2 as having an oblong form, but could readily be formed in any desired shape, such as round or square. In the form illustrated, the container 10 is nestable, i.e. one container is stackable within another so that a quantity of containers may be stored using a minimum of space.

Surrounding the open end of container 10 is a peripheral flange 16, which may extend completely or partially around the circumference of the container. As shown in FIGS. 1–4, the peripheral flange 16 is substantially flat along the upper surface of the container. The peripheral flange 16 may be integrally formed in the container during molding. As best seen in FIG. 2, the peripheral flange 16 includes a locking system comprising an integral female locking member 20 and an integral male locking member 30. The female locking member 20 comprises an open recess in the peripheral flange. The recess includes side faces 22, 22 and rear face 24. Preferably, the width of the recess is greater at the rear face 24 of the recess than at the front of the recess between tips 23, 23, resulting in the recess having a somewhat bell-shaped configuration.

Figure 7:
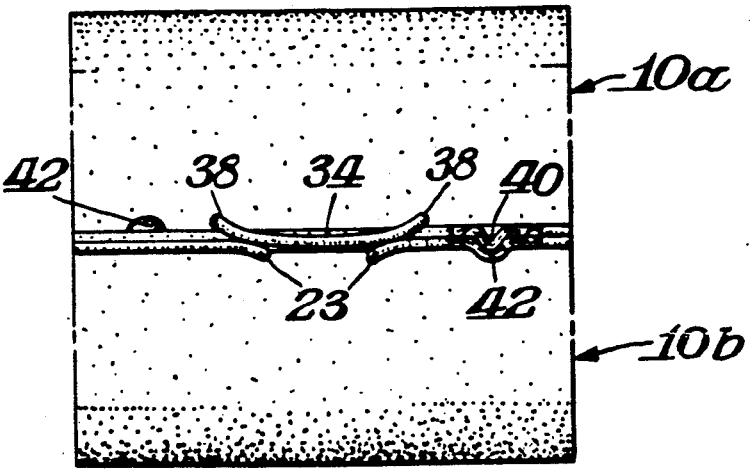
FIG. 7 is a fragmented front elevational view of the locking means visible in FIG. 5.

The male locking member 30 in its preferred form comprises a pair of angular recesses 32, 32 provided in the flange 16 to define a male tongue member 34. The outer face 36 of the male tongue member 34 includes extending tabs 38, 38. The distance between tabs 38, 38 make the male tongue member wider across its outer face 36 than at its base. Moreover, for proper locking function, the width of the male tongue member 34 at the outer face 36 between tabs 38, 38 should be wider than the width of the recess 20 comprising the female locking member. In this manner, when the male and female locking members are joined, the tabs 38,38 can extend through and hold the male locking member 34 within the recess 20 in the locked position. It will be noted that tips 23, 23 will engage against the bottom surface of the male member 34, as seen in FIG. 7.

The female locking member and the male locking member are positioned substantially symmetrically on opposing sides of the container. Thus, it will be apparent that the container is reversible in that it may serve as a lower component or upper component in a combination of two containers, referred to herein as a "composite container". A reversible container structure is desireable in that the same container construction may be used alone, for example as a dish, or together with another container to form a composite container. Thus, a food service operator could withdraw a single container from a nested stack, or, if necessary, draw two like containers from the same stack to form a composite container.

Figure 5:
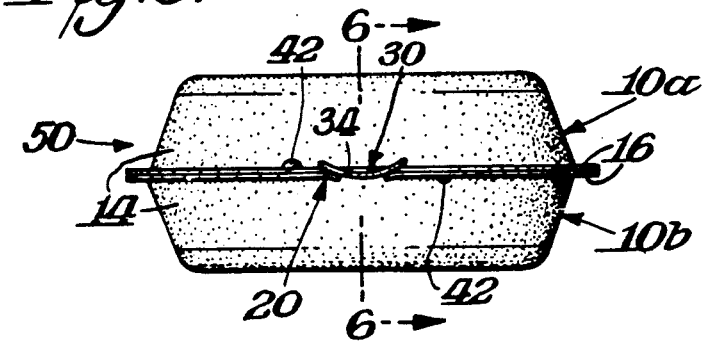
FIG. 5 is a front elevational view of a composite container.
Figure 6:
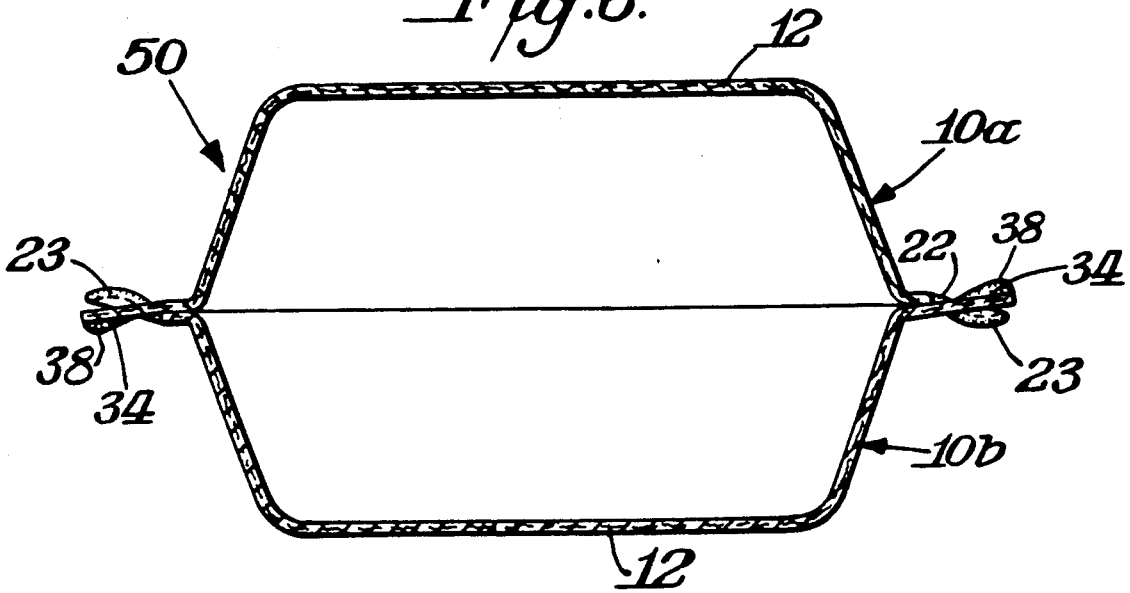
FIG. 6. is a cross-sectional view thereof, as viewed from line 6—6 in FIG. 5.

It will be appreciated by those in the art that, to form a closed composite container, a first container 10*a* is inverted and rotated 180° relative to a second container 10*b*, as seen in FIGS. 5 and 6. In this manner, the male and female locking members of the first container are operatively positioned relative to the female and male locking members of the second container. To lock the container, each male tongue member is inserted through the female recess on each side of the composite container. The male member 34 may be bent slightly to facilitate its fit into the recess 20. When the bend is released, tabs 38, 38 of the male member will rest upon side walls 22, 22 of the recess to lock the containers together, as seen in FIG. 7.

It has been found that the locking arrangement of the male and female locking members in the composite container may be stabilized against dislodging forces by providing lock stabilizer means on the container flanges. The lock stabilizer means serves to maintain the locked engagement of the male and female members against forces exerted on the sides, top, or bottom of the composite container, or sliding forces between the upper and lower containers. Such forces may normally be sufficient to disrupt the locking engagement of the containers forming the composite container.

In its preferred form, the lock stabilizer means comprises a number of protrusions and corresponding depressions provided in the upward face of peripheral flange 16. The protrusions and depressions are arranged such that when two containers 10*a* and 10*b* are positioned together to form a locked composite container, each protrusion is fitted matingly into a corresponding depression.

Figure 1:
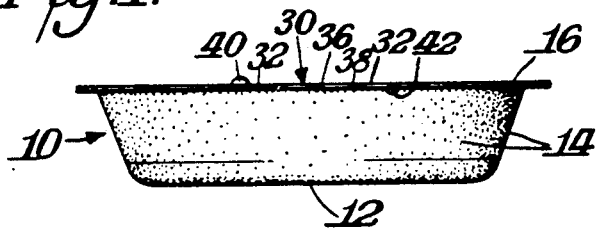
FIG. 1 is a front elevational view of a container.
Figure 3:
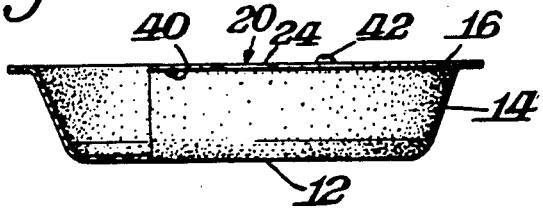
FIG. 3 is a rear elevational view thereof, partially broken away.

Referring to FIGS. 1 and 2, a container is shown with peripheral flange 16 having protrusions 40, 40 and depressions 42, 42. In this arrangement, both the male and female locking member are each flanked by one circular depression and one circular protrusion. In practice, however, the number and position of the protrusions and depressions may vary considerably. It is preferred that the protrusions and depressions be positioned closely adjacent to the locking members, as shown, to most effectively resist forces (e.g. sliding, pulling, or pushing between the containers) which may tend to dislodge the locking means.

Figure 8:
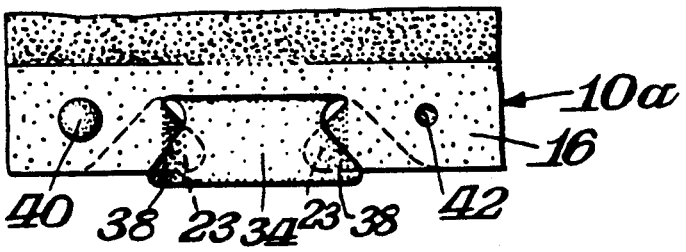
FIG. 8 is a fragmented top plan view of the locking means shown in FIG. 7.

The locking arrangement between the male and female locking members, and the lock stabilizer means, are illustrated in more detail in FIGS. 5, 7, and 8. When a first container 10*a* is operatively positioned with a second container 10*b*, the male tongue 34 is inserted into the female recess 20 on each side of the composite container such that tabs 38, 38 protrude through the recess and contact the opposite side walls 22, 22 to establish the locked position, as seen in FIGS. 7 and 8. In this locked position, each protrusion 40 is positioned to matingly engage its corresponding depression 42, as best seen in FIG. 7. To open the composite container, it is necessary only to grasp the male tongue 36 and pull it back through the recess 20, thereby unlocking the containers. The lock stabilizer means does not significantly hinder deliberate opening of the composite container, but serves to considerably reduce inadvertant opening of the container.

While the invention has been described in terms of the currently preferred embodiment shown in the drawings, minor variations of the invention would be obvious to those skilled in the art and are embraced within the spirit of the invention as defined in the appended claims.

What is claimed is:

1. In a nestable container consisting of a base, sidewalls, and a flat peripheral flange having male and female locking members disposed in the flange on substantially opposing edges of the flange, whereby a first said container may be lockingly engaged with a second said container inverted thereover to form a substantially closed composite container, the improvement comprising:

the female locking member comprises an open recess within the flange wherein the width of the recess is greater at the rear face of the recess than at the front of the recess, the male locking member comprises a tongue member having a pair of extending tabs, the distance across the face of said tongue member between said tabs being greater than the width across the rear face of said recess, and the flange is provided with lock stabilizer means protecting the male and female members from accidental disengagement when handling forces are exerted on the composite container, said lock stabilizer means comprising protrusions and mating depressions formed integrally in the flat surface of said flange and positioned to closely flank each of the male and female locking members.

2. The container as claimed in claim 1 wherein one protrusion and one depression are positioned on the upward face of the flange on opposing sides of both the male and female members, and are positioned such that, in the locked position of two containers, each protrusion is matingly engaged with a corresponding depression.

3. The container as claimed in claim 1 wherein the container is composed of cellulose fibers.

4. The container as claimed in claim 1 wherein both the protrusions and the depressions are circular.

* * * * *